US008490819B2

(12) United States Patent
Vanblaere et al.

(10) Patent No.: US 8,490,819 B2
(45) Date of Patent: Jul. 23, 2013

(54) CONTAINER FOR HOLDING A FLUID AND AN ASSEMBLY OF A CONTAINER AND AN OUTLET

(75) Inventors: Roland Vanblaere, Houthalenhelchteren (BE); Willy Kegels, Sint-Gillis-Waas (BE)

(73) Assignee: Packaging Technology Participation S.A., Luxembourg (LU)

( * ) Notice: Subject to any disclaimer, the term of this patent is extended or adjusted under 35 U.S.C. 154(b) by 760 days.

(21) Appl. No.: 12/530,802

(22) PCT Filed: Mar. 12, 2008

(86) PCT No.: PCT/EP2008/052952

§ 371 (c)(1),
(2), (4) Date: Apr. 14, 2010

(87) PCT Pub. No.: WO2008/110574

PCT Pub. Date: Sep. 18, 2008

(65) Prior Publication Data

US 2010/0213196 A1 Aug. 26, 2010

(30) Foreign Application Priority Data

Mar. 12, 2007 (GB) ..... 0704745.9

(51) Int. Cl.
*B65D 25/04* (2006.01)

(52) U.S. Cl.
USPC ..... 220/529; 220/500; 222/386.5

(58) Field of Classification Search
USPC ..... 220/500, 529, 530, 578; 222/386.5, 222/389, 464.1
See application file for complete search history.

(56) References Cited

U.S. PATENT DOCUMENTS

| | | | | |
|---|---|---|---|---|
| 3,099,370 | A * | 7/1963 | Hein | 222/386.5 |
| 3,245,591 | A * | 4/1966 | Kneusel et al. | 222/389 |
| 4,106,674 | A * | 8/1978 | Schultz | 222/386.5 |
| 2005/0211795 | A1 | 9/2005 | Ueda et al. | |

FOREIGN PATENT DOCUMENTS

| | | |
|---|---|---|
| JP | S37-004392 | 12/1958 |
| JP | S59-001380 | 1/1984 |
| JP | 2004-081955 | 3/2004 |
| JP | 2006-124016 | 5/2006 |

* cited by examiner

*Primary Examiner* — Harry Grosso
(74) *Attorney, Agent, or Firm* — Wolf, Greenfield & Sacks, P.C.

(57) ABSTRACT

A container (1) for holding a fluid comprising: a fluid chamber (2) having an inner wall (3); an outlet-opening (14); and a high pressure chamber (4) for driving the fluid towards the outlet-opening; wherein the container further comprises as at least part of a divider between the high pressure chamber and the fluid chamber a moveable element (5) for advancing in a predetermined direction of motion through the container from a first position to a second position for reducing a volume of the fluid chamber when fluid is dispensed via the outlet-opening, wherein a first and a second cross section of the fluid chamber taken transverse the direction of motion at respectively the first and second position have different dimensions.

18 Claims, 6 Drawing Sheets

CONTAINER FOR HOLDING A FLUID AND AN ASSEMBLY OF A CONTAINER AND AN OUTLET

Figure 1:
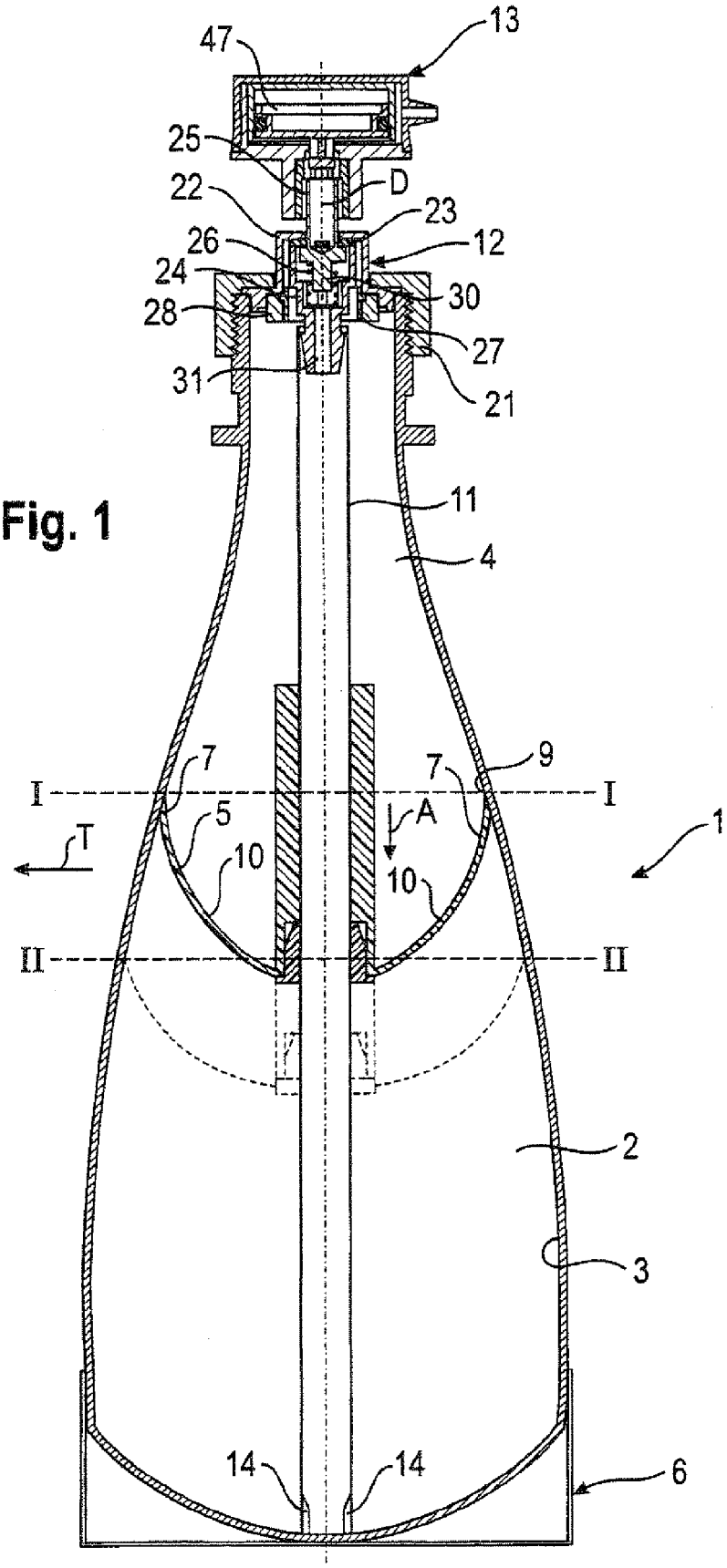

The application is related to a container for holding a fluid comprising: a fluid chamber having an inner wall; an outlet-opening; and a high pressure chamber for driving the fluid towards the cutlet-opening.

The invention is further related to an assembly of a container having a fluid chamber for holding a fluid which is to be dispensed and an outlet adapted for connection to the container for releasing the fluid from the fluid chamber.

The invention is further related to a container for holding a viscous fluid comprising a fluid chamber having an outlet opening; and a high pressure chamber for driving the fluid towards the outlet-opening.

BACKGROUND OF THE INVENTION

A container for holding a fluid is for instance known from WO 01/09009 A1 which shows a container that in use holds a fluid comprising both a pressurized driving gas and a product fluid which is meant to be dispensed.

Certain fluid products to be dispensed are however not to be intermixed with a pressurized driving gas. When a gaseous fluid is to be dispensed, intermixing may not only imply a dilution of the fluid to be dispensed but may sometimes also be harmful. Furthermore, it has turned out that gas pockets in a denser fluid product are in general undesired. This is related to the fact that viscosity, density and surface tension are all properties which often differ enormously between a pressurized gas and a dense or viscous fluid to be dispensed. Hence, when pockets of pressurized gas are present in the product fluid the dispensing dynamics change, resulting in unpredictable and/or irregular dispensing behaviour.

Both WO 2004/065217 A2 and WO 2004/065261 A1 disclose a fluid dispensing system showing a product chamber for holding the fluid to be dispensed and a high pressure chamber as well as a working pressure chamber for providing a more or less constant working pressure on the fluid to be dispensed. The chambers in which pressurized gas is held, i.e. the high pressure chamber and the working pressure chamber, are separated from the product chamber. The working pressure chamber increases in volume at the expense of the volume of the product chamber, as such keeping up the working pressure on the product. However, the expansion of the working pressure chamber occurs within the product chamber in such a way that certain volume parts of the product fluid are not satisfactorily driven out of the product chamber when the product fluid is to be dispensed.

WO 99/62791 discloses a container for holding a fluid wherein a volume of the chamber in which the product is held, can be reduced by moving a piston-like element in the direction of the product chamber. Such a construction restricts the window of design parameters, forcing a designer to work almost exclusively with a piston and cylinder-like arrangement, also known as a cylindrical arrangement.

Design of a container for holding a dispensable fluid is however not only restricted by constructional constraints or constraints related to the dispensing of the fluid.

Problems which need to be solved for obtaining a commercially viable container are also related to the fabrication of the container and are related to both the filling of the container with the fluid to be dispensed and the application of a high pressure chamber for driving the fluid out of the container.

Another problem often encountered in containers for holding a dispensable fluid has to do with a reduced stability of the container when nearly empty and in an upright position. The centre of gravity may gradually move upwards as fluid is being dispensed and a working pressure chamber situated near a bottom of the container expands upwards. When slightly and unintentionally tilted, for instance due to accidentally knocking it when placing another container next to it, the container my fall over as a consequence of its reduced stability.

It is an object of the invention to meet at least to some extent one of the problems mentioned above.

SUMMARY OF THE INVENTION

In an embodiment of one aspect of the invention there is provided a container for holding a viscous fluid comprising a fluid chamber having an outlet-opening; and a high pressure chamber for driving the fluid towards the outlet-opening. The container also comprises as at least part of a divider between the high pressure chamber and the fluid chamber a moveable element for advancing in a predetermined direction of motion through the container from a first position to a second position for reducing a volume of the fluid chamber when fluid is dispensed via the outlet-opening. In an upright position of the container is the first position above the second position.

In the upright position, the container will maintain a very stable position given that the fluid with the higher density, i.e. the fluid to be dispensed, remains positioned at the lower end of the container even when a part of that fluid has already been dispensed. Further, when in use the container is in the upright position and a pressurized gas is used in the high pressure chamber, the high pressurized gas will not diffuse into the viscous fluid to be dispensed as in this orientation of the container the fluid to be dispensed is below the high pressure chamber. Gas pockets will consequently not be formed. The interface between the high pressurized gas and the fluid to be dispensed is unlikely to offer positions at which the high pressurized gas can easily mix with the fluid to be dispensed, given that in use the moveable element presses downwards onto the fluid product.

In an embodiment of another aspect of the invention there is provided a container for holding a fluid. The container comprises a fluid chamber having an inner wall; an outlet-opening; and a high pressure chamber for driving the fluid towards the outlet-opening. The container further comprises as at least part of a divider between the high pressure chamber and the fluid chamber a moveable element for advancing in a predetermined direction of motion through the container from a first position to a second position for reducing a volume of the fluid chamber when fluid is dispensed via the outlet-opening. A first and a second cross section of the fluid chamber taken transverse the direction of motion at respectively the first and second position, have different dimensions. The moveable element is a resilient element which is biased towards expanding in directions transverse the predetermined direction so that tight contact between the element and inner wall of the container is maintained during movement of the moveable element from the first to the second position.

In this embodiment of a container, the fluid chamber remains fully separated from the high pressure chamber and it thus holds that the fluid to be dispensed remains separated from high pressurized gas in cases where such a gas is employed for driving the fluid towards the outlet. This effect will remain present, independent from a change of cross sectional dimensions of the container at different positions along the predetermined direction. In other words, the container does not necessarily have to be cylindrical in shape having its axis parallel to the predetermined direction to drive most if not all the dispensable fluid out of the container and/or to maintain complete separation of driving gas and fluid to be dispensed.

This embodiment allows for a higher flexibility in design of the fluid chamber and the container as a whole, and allows thus for a more fanciful design of, for instance, a bottle of hand cream with a dispensing mechanism. Clearly, this embodiment of a container also reduces the likelihood of fluid remaining unused in the container after dispensing the fluid.

In an embodiment of another aspect of the invention there is provided an assembly comprising a container having a fluid chamber for holding a fluid which is to be dispensed and an outlet.

The outlet is adapted for connection to the container for releasing the fluid from the fluid chamber. The outlet comprises a movable blocking element which can adopt a release position in which the blocking element blocks in the outlet a fluid path for releasing fluid from the fluid chamber. The blocking element can adopt a blocking position for blocking at a fluid closing point the fluid path in the outlet so that fluid cannot be released from the fluid chamber. The container further has a high pressure chamber for holding gas for driving the fluid towards the outlet.

As the fluid path for releasing fluid from the fluid chamber can be blocked, it is possible to avoid a gas entering the fluid chamber from a position downstream the fluid path for releasing fluid from the fluid chamber. This allows for using a downstream part of the fluid path for filling the high pressure chamber whilst keeping the design of the outlet simple. The container and the outlet are in a simple way suitable for both dispensing the fluid from the fluid chamber and filling the high pressure chamber with gas.

Figure 2:
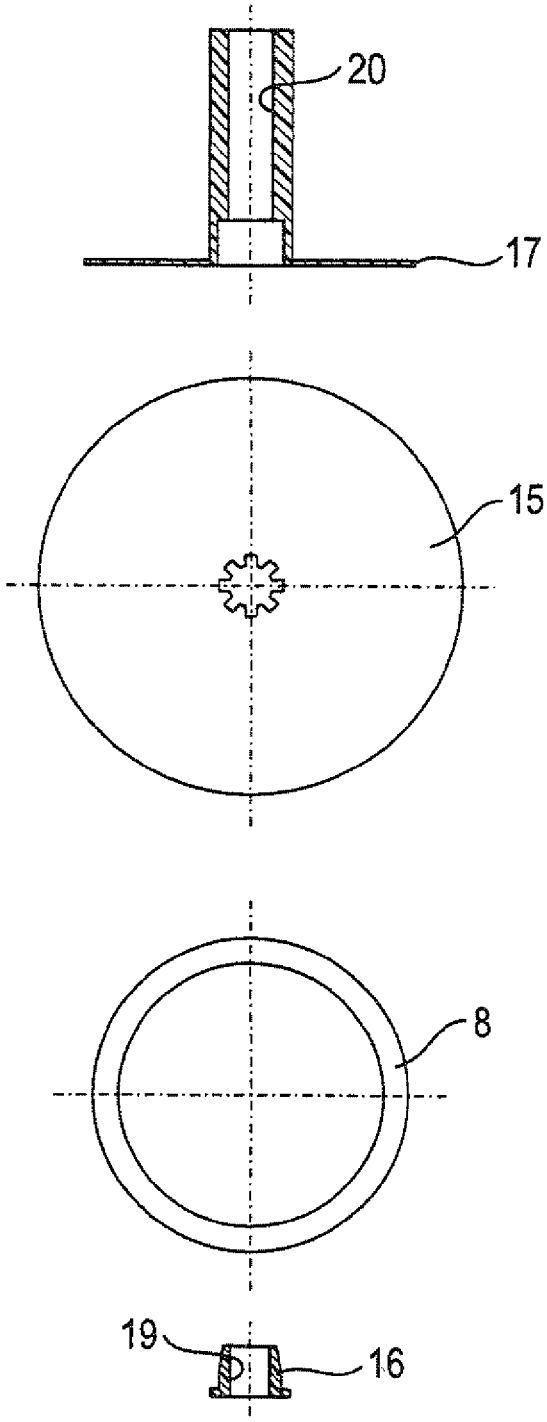
Figure 3:
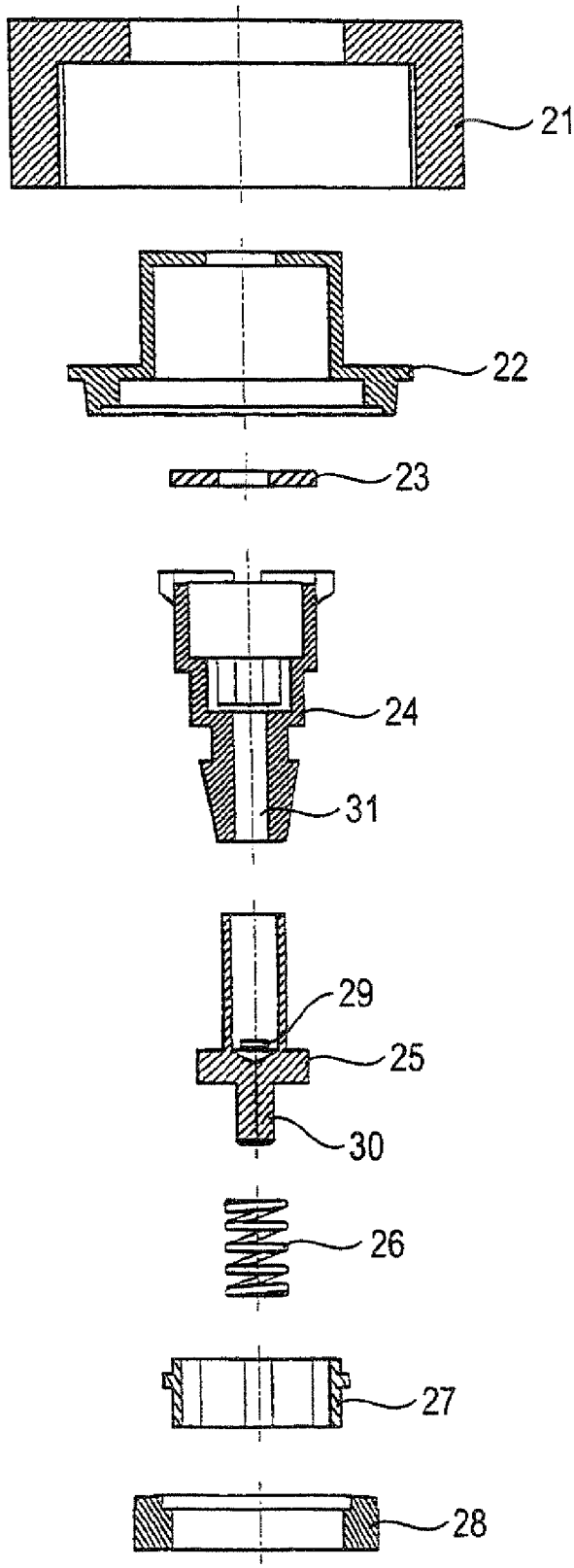
Figure 4:
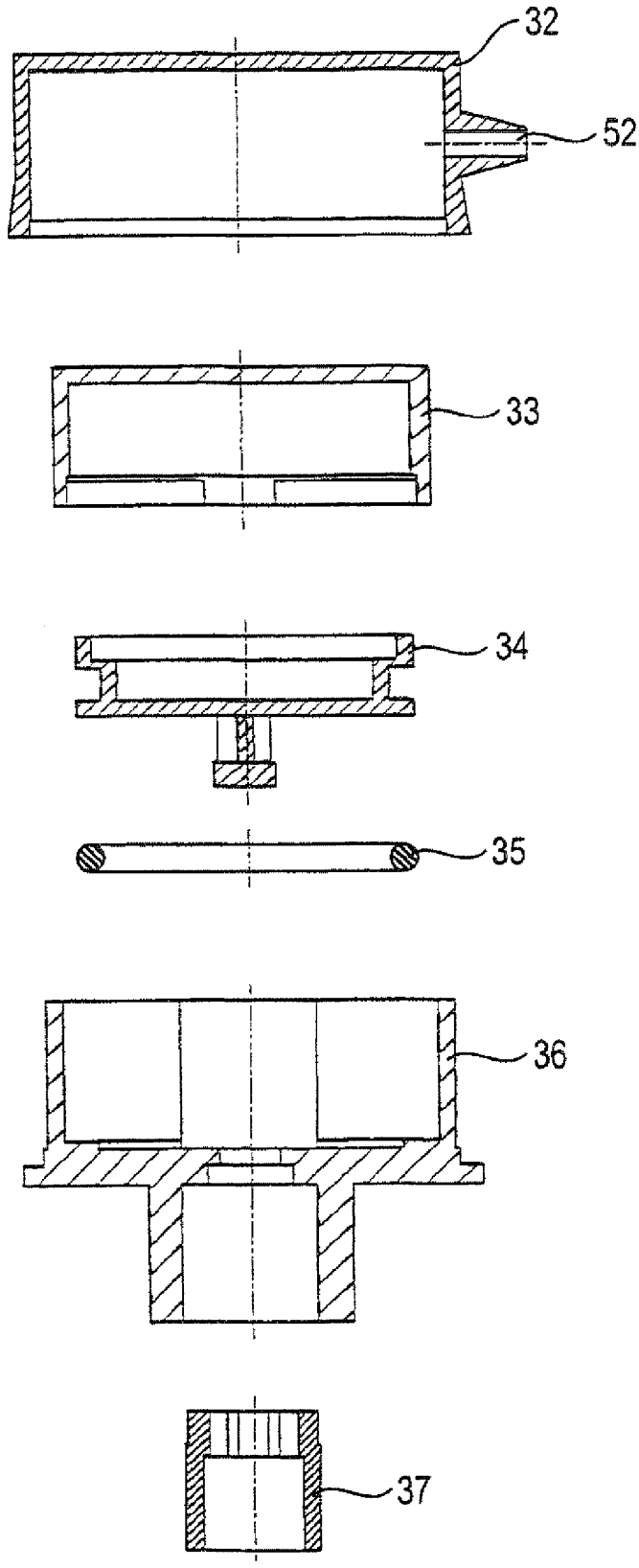

The invention will further be illustrated in the description with reference to the drawing. In the drawing shows:

FIG. 1: schematically in cross sectional view an embodiment of a container in accordance with at least one aspect of the invention;

FIG. 2: schematically in an exploded view a moveable element of an embodiment of a container in accordance with at least one aspect of the invention;

FIG. 3: schematically in an exploded view details of an embodiment of an outlet of an assembly in accordance with the invention;

FIG. 4: schematically in an exploded view an embodiment of a pressure control device in accordance with at least one aspect of the invention.

Figure 5:
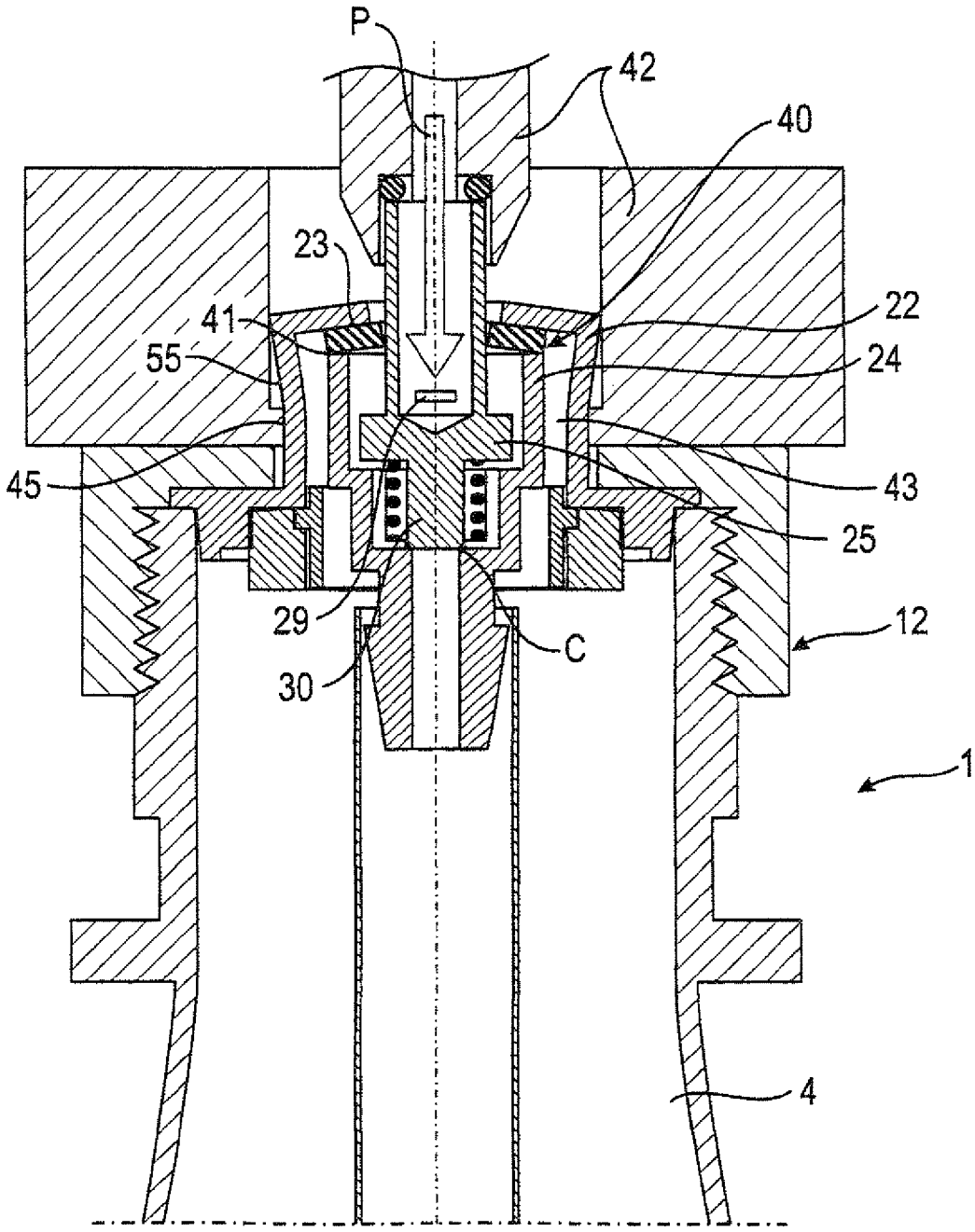
Figure 6:
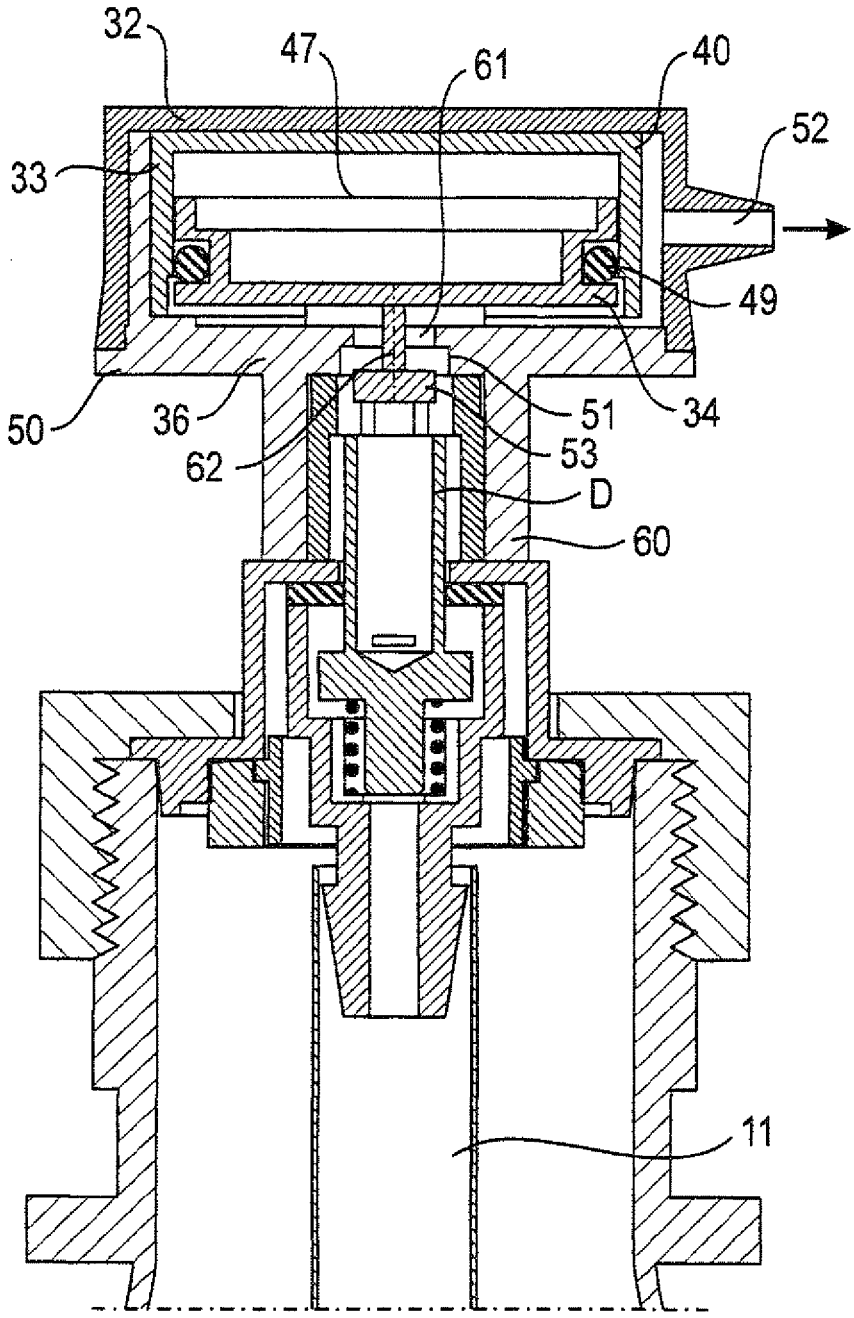

FIG. 5: schematically in a cross sectional view an embodiment of an assembly in accordance with one aspect of the invention further showing a connection;

FIG. 6: schematically in a cross sectional view an embodiment of an assembly in accordance with one aspect of the invention whilst dispensing.

In the drawing like parts are provided with like references.

FIG. 1 shows an embodiment of a container 1 for holding a fluid. The container 1 comprises a fluid chamber 2 having an inner wall 3. The container 1 further comprises an outlet-opening which in FIG. 1 is situated at an upper part of the container 1 and for reasons of clarity not indicated by a reference number as the opening itself is incorporated in a part which will be discussed later. It will later be discussed how this outlet-opening communicates for instance with the fluid chamber 2. The container further comprises a high pressure chamber 4 for driving the fluid towards the outlet-opening. The container 1 further comprises as at least part of a divider between the high pressure chamber 4 and the fluid chamber 2 a moveable element 5 for advancing in a predetermined direction of motion, indicated by arrow A, through the container 1, from a first position, as shown in FIG. 1 by solid lines, to a second position, as schematically shown by dashed lines. The first and second position of the moveable elements are arbitrarily taken as positions where the moveable element 5 has contact with the inner wall 3. When in use the moveable element 5 moves from the first position to the second position, a volume of the fluid chamber 2 is reduced. As will be explained later, this will happen when fluid is dispensed via the outlet opening. A first cross section, indicated by the line I-I, taken transverse the direction of motion at the first position of the moveable element 5, has a dimension which is different from a second cross section of the fluid chamber 2, indicated by the line II-II, at the second position.

The moveable element 5 is a resilient element which is biased towards expanding in directions transverse, indicated by arrow T, relative to the predetermined direction, indicated by arrow A. A tight contact between the moveable element 5 and the inner wall 3 of the container 1 is as a result of this bias as maintained, also during movement of the moveable element 5 from the first to the second position.

As shown in FIG. 1, in an upright position of the container 1, the predetermined direction is downwards. The upright position is the position in which the container is placed when put away for instance on a shelf when not in active use. The container is usually provided in a shape so that it is immediately clear to a user which position of the container can be used as the upright position it follows that in the upright position, the first position is above the second position. This means that when the moveable element 5 advances in the predetermined direction of motion through the container 1 for reducing a volume of the fluid chamber 2, the highest level of the fluid which remains in the container 1, is lower than the highest level of the fluid which previously remained in container 1. The centre of gravity of the fluid moves downward as the relatively heavy fluid is being dispensed from the fluid chamber 2. As the centre of gravity of the residual fluid will move toward a bottom 6 of the container 1, stability of the container 1 is optimized even though very little fluid may be left in container 1.

As shown FIG. 1, the first and second cross section of the fluid chamber 2, taken transverse the direction of motion, have different dimensions at respectively the first and second position. Moveable element 5 is a resilient element which is biased towards expanding in directions transverse the predetermined direction, i.e. biased in a direction T transverse a direction A. The embodiment shown in FIG. 1 is such that tight contact between the element 5 and inner wall 3 of the container 1 is maintained during the movement of the moveable element 5 from the first to the second position. As shown, the moveable element 5 is moveable in its entirety. However, it is not inconceivable that parts of the moveable element are fixed with respect to the inner wall 3 of the container 1.

Although FIG. 1 shows an embodiment in which the predetermined direction is downward when the container is in an upright position, the predetermined position can also be chosen to be upward when the container is in an upright position. In general it applies that any direction can be chosen as the predetermined direction for reducing a volume of the fluid chamber. The advantage of the optimized continuing stability as present when the predetermined direction is downward, may in certain cases not be relevant. It is of course also possible to make the bottom of the container heavy so that stability is also guaranteed with a predetermined direction different from downward.

In an embodiment of a container according to the invention the moveable element 5 comprises an impermeable wall between the fluid chamber 2 and a high pressure chamber 4.

With an impermeable wall gas exchange between the fluid chamber and the high pressure chamber is drastically minimized if not fully excluded. As shown, the moveable element 5 may have a concave side facing the high pressure chamber 4. Also as shown, the moveable element 5 may have a convex side facing the fluid chamber 2. This also allows for a very simple embodiment of moveable element 5.

It is possible that the moveable element 5 comprises a rubber or an elastic plastic. It is further possible that the moveable element 5 is made of for instance PET.

As shown, the moveable element 5 may be biased by the bending outer portions 7 of the resilient member towards the high pressure chamber 4. The moveable element 5 may be provided with a relatively stiff ring 8 (not shown in FIG. 1) for obtaining a relatively stiff part of the moveable element within the ring and a relatively flexible part outside the ring. The moveable element 5 may have at outer part 9 which maintains contact with the inner wall 3 of the container 1, a flexibility which is higher than the flexibility at an inner part 10 which is free from contact with the inner wall 3 of the container 1.

It is possible that the moveable element 5 and the inner wall 3 are coaxially arranged, as shown in FIG. 1. The container may have rotational symmetry with respect to the predetermined direction A.

The container may be shaped such that at each next position which the moveable element 5 reaches when advancing in the predetermined direction A, the transverse cross section of the container 1 is larger than the cross section at a previous position. As the pressure in the high pressure chamber may reduce due to increase of its volume, it is advantageous to have the cross sectional dimensions of the container larger at following positions of the moveable element, as this means lesser friction between moveable element 5 and inner wall 3. This in turn means that advancement of the moveable element is still possible despite the lower "driving force" provided by the high pressure chamber 4.

As shown in FIG. 1, the container may comprise a guiding member 11 for guiding movement of the moveable element 5 in the predetermined direction A. The moveable element 5 and the guiding member 11 are, in this example, coaxially arranged within the container 1. As shown in the embodiment of FIG. 1, the guiding member 11 is hollow and arranged for transport of the fluid from the fluid chamber 2 towards the outlet-opening.

As shown in FIG. 1, the outlet-opening is arranged at the top of the container 1. However, at the outlet-opening an outlet 12 is situated in a way and for a reason further described when discussing FIG. 4.

In this specification, flow direction will be used for describing relative positions. This direction corresponds to the direction of the flow of the fluid to be dispensed. Relative positions are indicated by either "upstream" or "downstream".

Downstream the outlet 12 is a pressure control device 13 situated for dispensing the fluid within a predetermined range of pressure.

Before moving on to a description of the other figures, it is to be noted from FIG. 1 that when the moveable element 5 advances in the predetermined direction A, the volume of the fluid chamber 2 reduces, which is possible as the fluid can move via an entrance 14 in the hollow guiding member 11 towards the outlet 12. The entrance 14 of the hollow guiding member 11 is situated near a bottom 6 of the container 1. It will be clear that it is also possible to have the guiding member 11 solid, and to have another channel for flow of fluid from the fluid chamber to the outlet 12. It is also possible to have the outlet-opening and outlet 12 directly in the fluid chamber.

In a very advantageous embodiment of a container in accordance with an aspect of the invention, the high pressure chamber holds a gas having a pressure high enough to move at least part of the moveable element 5 when fluid is dispensed so that fluid is driven towards the outlet 12 via the hollow guiding member 11. Although highly pressurized gas is preferably used, it is not inconceivable that the high pressure chamber is capable of providing a high pressure onto the moveable element due to, for instance, a spring present in the high pressure chamber 4.

In an exploded view, FIG. 2 shows moveable element 5 of an embodiment of a container 1 in accordance with an aspect of the invention. This embodiment of a moveable element 5 comprises a sheet or film 15 as in use clamped between a clamping assembly comprising a male part 16 and a female part 17. As shown, in this embodiment is the moveable element 5 arranged such that the guiding member 11 can coincide with the axes of the moveable element 5. The moveable element 5 may also comprise a ring 8 as earlier discussed. The film 15 may be of a flexible material such as PET or a thin rubber material. Ring 8 will be of a material that is stiff relative to the film 15 and also the clamping assembly with male and female parts 16, 17 may be of a relatively stiff plastic. An inner wall 19 and 20 of respectively male and, female part 16 and 17 has preferably a low friction surface and may for instance be coated with a Teflon® layer to facilitate sliding along the guiding member 11.

FIG. 3 shows schematically in an exploded view details of an outlet of an embodiment of the invention. The corresponding parts are also shown in FIG. 1 as assembled into an outlet 12 which is placed in the outlet opening. FIG. 3 shows respectively an outer mounting cup 21, a stem holder cup 22, an O-ring 23, a stem holder 24, a stem 25, a spring 26, a spring holder 27, and an inner clampable stop 28. Stem 25 comprises an outlet channel 29. The manner in which these parts are positioned with respect to each other in an assembled outlet is shown in FIG. 1. It will be clear that in use the stem 25 is biased by spring 26 such that the outlet 12 is closed by positioning the outlet channel 29 against the O-ring 23. When the stem is in this position, the outlet is closed for a fluid flow from the outlet 12 to a downstream position. When the stem 25 is moved downwards, as will be further explained when FIG. 6 is described, a fluid path between the hollow guiding member 11 and a downstream position of the cutlet 12 will become available. As will also be explained later, the extent to which the stem 25 can be pushed downward by someone who operates the container for dispensing a fluid, is deliberately made limited, so that under those circumstances part 30 of stem 23 cannot close entrance 31 of stem holder 24. However, the stem 25 can be pressed downwards further as will be explained when FIG. 5 is discussed. When the stem 25 is, under the circumstances shown in FIG. 5, pressed down further, the stem 25 has as a blocking element adopted a blocking position in the cutlet 12 for blocking the fluid path in the outlet so that fluid cannot be released from the fluid chamber 2 into the outlet 12.

FIG. 4 shows schematically and in an exploded view a pressure control device 13 of an embodiment in accordance with the invention. The pressure control device 13 is associated with the container and is in use mounted on the outlet 12 itself which is placed in the outlet opening of the container 1. The pressure control device is used for dispensing the fluid within a predetermined pressure range. As more clearly shown in FIG. 4, the pressure control device 13 comprises the following parts:

an upper cap 32 having a fluid exit, an inner cap 33, a piston 34, an O-ring 35, a main body 36 and a stopping member 37.

The way these parts are assembled in use in the pressure control device 13 is shown in FIG. 1

The way the pressure control device 13 works is described in a number of applications of the Applicant. In relation to this, reference is made to the pressure controller described in for instance WO 99/62791, the pressure controller WO 2004/065260 and the pressure controller described in WO 2004/065261. Further below in the description of the current specification will again be explained how the pressure control device works.

Reference is now made to FIG. 5 which shows an assembly comprising a container (of which only an upper part is shown) having a fluid chamber (not shown) for holding a fluid which is to be dispensed and an outlet 12 adapted for connection to the container 1 for releasing the fluid from the fluid chamber. In general, the outlet 12 comprises a moveable blocking element, for example stem 25 having part 30, which can adopt a release position as is shown in FIG. 6, in which the blocking element unblocks in the outlet 12 a fluid path for releasing fluid from the fluid chamber toward the pressure control device 13. However, as shown in FIG. 5, the blocking element can also adopt a blocking position for blocking at a fluid closing point C the fluid path in the outlet 12 so that fluid cannot be released from the fluid chamber of the container 1 into the outlet 12. Is more clearly shown in FIG. 1 the container 1 further has a high pressure chamber 4 for holding gas for driving the fluid towards the outlet 12.

The outlet 12 further comprises a valve 40 for filling the high pressure chamber 4 with pressurized gas. Valve 40 is openable at a gas opening point 41 which is positioned in the outlet 12 with regard to the fluid path for releasing fluid, downstream of the fluid closing point C.

Still with reference to FIG. 5, the assembly further comprises a connector 42 for connecting the outlet 12 with a supply for highly pressurized gas. The assembly is further arranged so that when the connector 42 is connected to the outlet 12 and highly pressurized gas is supplied to the outlet 12, the blocking element, in this example part 30 of stem 25, is under the influence of the highly pressurized gas put in its blocking position. It is also possible that the blocking element is mechanically pushed into the blocking position, independent of the presence of a flow of high pressurized gas. The blocking element in the blocking position is shown in FIG. 5. The arrow P indicates the supply of the pressurized gas. The impact of the gas is in use high enough to move stem 25 downward against the spring force provided by spring 26, so that the blocking element closes the fluid path for releasing fluid. The outlet 12 and the connector 42 are further arranged such that when the connector 42 is connected to the outlet 12, the valve 40 can be opened due to mechanical engagement of the connector 42 and the outlet 12. In the embodiment shown in FIG. 5, this facility is arranged as follows. The stem holder cup 22 is made of a rather stiff, preferably metal, material. Between the stem holder cup 22 and the stem holder 24 is an annular space 43 available for communication with the high pressure chamber 4. As mentioned earlier, the outlet comprises an O-ring 23, which is as shown in FIG. 5 and in FIG. 1 sealingly placed inside the stem holder cup 22 between the stem holder cup and a top part of the stem holder 24.

The connector 42 may, as shown, further be provided with jaws 45. When the jaws 45 are pressed against an outer wall 55 of the stem holder cup 22, the stem holder cup 22 is at the pressed positions squeezed radially inwards, in this example at a relatively low position of the stem holder cup 22. In response to that, an upper part of the stem holder cup 22 moves slightly radially outwards. This causes the sealing of the O-ring 23 to be discontinued.

It is again to be noted that as a result of the highly pressurized gas supply, stem 25 moves into its blocking position so that gas will not enter the hollow guiding member 11. As pointed out earlier, stem 25 may also be pushed mechanically, i.e. without the occurrence of a gas flow, into the blocking position. For instance, when the connector 42 "rests" on the stem 25 as shown in FIG. 5, the part 30 of the stem is put in the blocking position. Once the fluid flow path is as such closed off at the fluid closing point C, the flow of high pressurized gas, as schematically indicated by arrow P, can commence. In those circumstances a gas communication is formed between the highly pressurized gas supply as schematically indicated by arrow P and the high pressure gas chamber 4, as via outlet channel 29 the highly pressurized gas can flow to an inner space of the stem holder 24 and via the discontinued sealing, i.e. the valve 40 at gas opening point 41, to the annular space 43 which is in gas communication with the high pressure chamber 4. When the high pressure chamber is filled up with gas to a sufficiently high pressure, the gas supply will be discontinued and the jaws 45 of the connector will be taken radially outward. Consequently, O-ring 23 will resume its sealing function and the high pressure chamber 4 is in those circumstances again sealed off from an inner space of the stem holder 24. Obviously, stem 25 will under the influence of the spring force 26 and in the absence of any other forces applied to the stem 25 move back from the blocking position into the position at which O-ring 23 seals off outlet channel 23 so that no fluid can flow downstream the outlet 12.

With reference to FIG. 6 it is now explained how the container 1 provided with the outlet 12 and a pressure control device 13 can be operated by a user for dispensing a fluid.

Before explaining in more detail how operation works, attention is drawn to the embodiment of valve 40 in FIG. 6, which is different from the embodiment of valve 40 shown in FIG. 5. However, it can clearly be envisaged that if the outlet of FIG. 6 is connected up to connector 42 and jaws 45 squeeze the lower part of stem holder cup 22, valve 40 will open up and a fluid path will exist between an inner space of stem holder 24 and the annular space 43.

For a good understanding of the operation of the embodiment shown in FIG. 6, reference is first again made to FIG. 1 as this shows a starting point for the use of the FIG. 6 embodiment. In FIG. 1 is shown that stem 25 is under the influence of spring 26 pushed upward so that outlet channel 29 is blocked off by O-ring 23. In other words, in this configuration there is no fluid connection between the fluid chamber 2 and a position D, downstream the outlet 12. When the pressure control device 13 is pressed downwards as shown in FIG. 6 the stem 25 is pressed downwards against the spring force of spring 26. However, as mentioned earlier, the extent to which stem 25 can be pushed downward by someone who operates the container for dispensing a fluid, is in this embodiment deliberately made limited, so that part 30 of stem 25 can under those circumstances not close entrance 31 of stem holder 24. It is under these circumstances that a fluid connection will be formed between a position in the hollow guiding member 11 and position D downstream of the outlet 12.

A reference pressure chamber 47 is formed by an inner cap 33 and the earlier described piston 34. Although this predetermined pressure could be applied by a spring positioned in reference chamber 47, in the embodiment shown, the reference pressure is applied by a gas present in the reference chamber 47 at the reference pressure. The piston 34 is provided with a sealing ring 35 for preserving the gas in the reference pressure chamber 47.

The cap 33 is mounted on a main body 36. Mounted over the inner cap 33 and on the main body 36 is an upper cap 32 which is provided with an exit 52 for the fluid to be dispensed. The main body 36 has a lower part 60 which is arranged to be mounted on an upper part of the stem 25. The lower part 60 of the main body 36 has a length suitable for ensuring that the stem 25 is pushed to a position in which the channel outlet 29 is unblocked and the entrance 31 of the outlet 12 is unblocked. The lower part 6 of the main body abuts stem holder cup 22, so that pushing the pressure control device 13 further down is not possible. In this way also the extent to which stem 25 can be pushed downwards is limited.

At this position a fluid connection is established between the hollow guiding member 11 and position D downstream of the outlet 12. In other words, the pressure control device 13 can only be pressed downward up to a position from which it can no further be pressed downward due to the abutment of the lower part 60 of the main body 36 and an outer part of the stem holder cup 22. When the stem 25 is at this position, fluid will flow or be pressed towards the pressure control device 13. This flow or pressure originates from the pressure applied by the high pressure chamber 4 and via the moveable element 5 passed on to fluid in the fluid chamber 2.

For a good appreciation of the working of the pressure control device 13, the device will now be described in more detail than before.

The piston 34 of the pressure control device 13 is provided with a piston stem 62 which at its lower end is provided with a relatively small blocking element 53. The stem 25 extends through an opening 61, which can be blocked by blocking element 53, depending on the position of the piston 34.

For optimally controlling the pressure of the fluid to be dispensed is the pressure in the reference chamber 47 higher than the atmospheric pressure and lower than the pressure of the fluid to be dispensed at position D when the pressure control device is pressed down to allow a fluid connection between the hollow guide member 11 and position D to be formed. The pressure at position D could for instance be about 4 bar, depending on the pressure in the high pressure chamber 4 and the resistance formed by hollow guide member 11 and outlet 12.

As the reference pressure is higher than atmospheric, the opening 61 will initially be unblocked. Once fluid flows toward the pressure control device at position D, the pressure of the fluid downstream the opening 61 and/or blocking element 53 will contribute to the positioning of the piston 34. Fluid pressure experienced by the relatively small blocking element 53 does also contribute to the positioning of the piston 34, in proportion to the size of the blocking element 53. If the pressure of the fluid downstream the opening 61 and blocking element 53 is higher than the reference pressure in the reference chamber, the piston 34 will move upwards and the blocking element 53 will block opening 61. The pressure of the fluid downstream the opening 61 will then quickly drop due to dispensing via exit 52. Once the reference pressure becomes higher than the pressure downstream the opening 61, the piston will move downwards and opening 61 will reopen again, etc. This mechanism ensures that the fluid is dispensed with a pressure within a predetermined range.

Assembling and filling the container 1 is possible in a straightforward and economical way. The fluid to be dispensed may first be put in the container. Then the guide member 11 and moveable element 5 can be placed into the container 1. The outlet 12 can be placed so that an outlet opening of the container is incorporated in the outlet 22. The high pressure chamber 2 can then be filled with gas in a way described above. Finally, the pressure control device is placed onto stem 25

Aspects of the invention are not limited to the embodiments described above. Many variations are possible. In particular the connector 42 can be a single part or multiple part connector. The movement of jaws 45 may be independent of the supply of highly pressurized gas, indicated by arrow P.

Most of the possible variations have already been described above throughout the description of the drawings. Such variations are all understood to fall within the scope of the various aspects of the invention, as defined by the appended claims.

The invention claimed is:

1. A container for holding a fluid comprising:

a fluid chamber having an inner wall and an outlet-opening; and a high pressure chamber for driving the fluid towards the outlet-opening;

wherein the container further comprises as at least part of a divider between the high pressure chamber and the fluid chamber a moveable element for advancing in a predetermined direction of motion through the container from a first position to a second position for reducing a volume of the fluid chamber when fluid is dispensed via the outlet-opening, wherein a first and a second cross section of the fluid chamber taken transverse to a direction of motion at respectively the first and second position have different dimensions, wherein at one of the second positions, the transverse cross section of the container is larger than at one of the first positions, wherein the moveable element is a resilient element which is biased towards expanding in directions transverse relative to the predetermined direction so that tight contact between the element and the inner wall of the container is maintained during movement of the moveable element from the first to the second position.

2. The container according to claim 1, wherein in an upright position of the container the first position is above the second position.

3. The container according to claim 1, wherein the moveable element is moveable in its entirety.

4. The container according to claim 1, wherein the moveable element comprises an impermeable wall between the fluid chamber and the high pressure chamber.

5. The container according to claim 1, wherein the moveable element has a concave side facing the high pressure chamber.

6. The container according to claim 1, wherein the moveable element has a convex side facing the fluid chamber.

7. The container according to claim 1, wherein the moveable element comprises one of a rubber and an elastic plastic.

8. The container according to claim 1, wherein the moveable element is biased by bending of outer portions of the resilient member towards the high pressure chamber.

9. The container according to claim 1, wherein the moveable element is provided with a relatively stiff ring for obtaining a relatively stiff part of the resilient element within the ring and a relatively flexible part outside the ring.

10. The container according to claim 1, wherein the moveable element has, at a part which maintains contact with the inner wall of the container, a flexibility which is higher than the flexibility at a part which is free from contact with the inner wall of the container.

11. The container according to claim 1, wherein the moveable element and the inner wall are coaxially arranged.

12. The container according to claim 1, wherein the container has rotational symmetry with respect to the predetermined direction.

13. The container according to claim 1, wherein at each next position which the moveable element reaches when advancing in the predetermined direction, the transverse cross section of the container is larger than a previous cross section.

14. The container according to claim 1, wherein the container comprises a guiding member for guiding movement of the moveable element in the predetermined direction.

15. The container according to claim 14, wherein the moveable element and the guiding member are coaxially arranged within the container.

16. The container according to claim 14, wherein the guiding member is hollow and arranged for transport of the fluid from the fluid chamber towards the outlet-opening.

17. The container according to claim 1, wherein the high pressure chamber holds a gas having a pressure high enough to move at least a part of the moveable element when fluid is dispensed so that fluid is driven towards the outlet-opening.

18. The container according to claim 1, wherein the container is associated with a pressure control device for dispensing the fluid within a predetermined pressure range, the container and the pressure control device being adapted to maintain in use a connection for flow of the fluid from the container to the pressure control device.

* * * * *